US012584697B2

(12) United States Patent
Schröter

(10) Patent No.: US 12,584,697 B2
(45) Date of Patent: Mar. 24, 2026

(54) DEVICE FOR CONTROLLING THE TEMPERATURE OF A COMPONENT AND METHOD FOR MANUFACTURING THE DEVICE

(71) Applicant: Fränkische Industrial Pipes GMBH & CO. KG, Königsberg (DE)

(72) Inventor: Dirk Schröter, Pfarrweisach (DE)

(73) Assignee: Fränkische Industrial Pipes GMBH & CO. KG, Königsberg (DE)

( * ) Notice: Subject to any disclaimer, the term of this patent is extended or adjusted under 35 U.S.C. 154(b) by 323 days.

(21) Appl. No.: 18/024,138

(22) PCT Filed: Sep. 3, 2021

(86) PCT No.: PCT/EP2021/074326
§ 371 (c)(1),
(2) Date: Mar. 1, 2023

(87) PCT Pub. No.: WO2022/058181
PCT Pub. Date: Mar. 24, 2022

(65) Prior Publication Data

US 2023/0324131 A1 Oct. 12, 2023

(30) Foreign Application Priority Data

Sep. 16, 2020 (DE) ..... 10 2020 211 603.2

(51) Int. Cl.
*F28F 3/12* (2006.01)
*F28D 21/00* (2006.01)
*F28F 9/02* (2006.01)

(52) U.S. Cl.
CPC ..... *F28D 21/00* (2013.01); *F28F 3/12* (2013.01); *F28D 2021/0029* (2013.01);
(Continued)

(58) Field of Classification Search
CPC .. F28F 2275/067; F28F 3/12; F28F 2255/143; F28F 9/0221
See application file for complete search history.

(56) References Cited

U.S. PATENT DOCUMENTS 5,725,051 A 3/1998 Veltkamp
2005/0161208 A1* 7/2005 Sucke ..... F28F 1/08 165/177

(Continued)

FOREIGN PATENT DOCUMENTS

DE 3145887 A1 6/1982
DE 3503607 A1 8/1986

(Continued)

OTHER PUBLICATIONS

Translation of DE102008059737A1 named Translation—DE102008059737A1 (Year: 2010).*

(Continued)

*Primary Examiner* — Paul Alvare
(74) *Attorney, Agent, or Firm* — Kilpatrick Townsend & Stockton LLP

(57) ABSTRACT

The present invention relates to a device for controlling the temperature of a component and a method of production thereof. The device includes an elongate basic profile that defines a plurality of fluid flow channels in its interior. The fluid flow channels are arranged in series and separated by webs. The elongate basic profile extrudes from a plastic material. The device includes a connection unit connected to the basic profile and designed to direct fluid into the basic profile or out of the basic profile. The connection unit is formed partially or completely from a transparent plastic material.

10 Claims, 7 Drawing Sheets

(52) U.S. Cl.
CPC ..... *F28F 9/0221* (2013.01); *F28F 2255/143* (2013.01); *F28F 2275/067* (2013.01)

(56) References Cited

U.S. PATENT DOCUMENTS

| | | | | |
|---|---|---|---|---|
| 2005/0247442 | A1 | 11/2005 | Daly | |
| 2006/0131007 | A1 | 6/2006 | Nes et al. | |
| 2010/0030192 | A1 | 2/2010 | Gunderson et al. | |
| 2015/0034287 | A1* | 2/2015 | Otto | H01M 10/647 165/168 |
| 2020/0052646 | A1* | 2/2020 | Fischer | H02S 40/44 |
| 2020/0124356 | A1* | 4/2020 | Ma | F01K 3/12 |
| 2023/0137448 | A1* | 5/2023 | Menner | F28F 9/06 285/125.1 |

FOREIGN PATENT DOCUMENTS

| | | | | |
|---|---|---|---|---|
| DE | 10356417 | A1 | 6/2005 | |
| DE | 102008059737 | A1 * | 6/2010 | F28D 1/05383 |
| DE | 102013215358 | A1 | 2/2015 | |
| EP | 1662223 | A1 | 5/2006 | |
| EP | 2344226 | A1 | 7/2011 | |
| WO | 2011069015 | A2 | 6/2011 | |
| WO | WO-2019057678 | A1 * | 3/2019 | |
| WO | 2019204836 | A1 | 10/2019 | |

OTHER PUBLICATIONS

German Application No. 10 2020 211 603.2, German Search Report mailed Apr. 12, 2021, 5 pages.
International Application No. PCT/EP2021/074326, International Search Report and Written Opinion mailed Dec. 20, 2021, 28 pages.

* cited by examiner

DEVICE FOR CONTROLLING THE TEMPERATURE OF A COMPONENT AND METHOD FOR MANUFACTURING THE DEVICE

CROSS REFERENCE TO RELATED APPLICATIONS

This application is a U.S. national phase of International Patent Application No. PCT/EP2021/074326 filed on Sep. 3, 2021, which claims priority to German Patent Application No. 10 2020 211 603.2, filed in Germany on Sep. 16, 2020. The entire contents of both applications are hereby incorporated herein by this reference.

The present invention relates to a device for controlling the temperature of a component, the device comprising an elongate basic profile which defines in its interior a plurality of at least two fluid flow channels from one longitudinal end to the other longitudinal end thereof, the fluid flow channels being arranged in series and separated by webs.

Devices for controlling the temperature of components are known from the prior art, such as heat sinks for dissipating heat generated by batteries, which are designed as substantially strip-shaped elongate bodies, with a multiplicity of fluid flow channels through which a fluid flows being formed in the interior of these bodies (also referred to as the "basic profile") to absorb and dissipate the generated heat. These devices, in particular the strip-shaped, elongate basic profiles thereof, are usually made of metal.

The formation of the hollow basic profiles from metal is relatively complex and therefore expensive.

It is therefore the object of the present invention to provide an alternative to the known metal basic profiles which is produced from a plastics material. However, since the production of the hollow, strip-shaped basic profiles from a plastics material, in particular using an extrusion method, is associated with production engineering problems which do not occur in the production of the basic profiles from metal, it is also the object of the present invention to provide solutions to the problems which occur in the production of hollow basic profiles from plastics material.

The above-mentioned object(s) are achieved according to the invention by a device for controlling the temperature of a component, the device comprising:

an elongate basic profile, which defines in its interior a plurality of at least two fluid flow channels from one longitudinal end to the other longitudinal end thereof, the fluid flow channels being arranged in series and separated by webs, and the elongate basic profile being extruded from plastics material, and a connection unit which is connected to the basic profile at one longitudinal end of the basic profile and which is designed to direct fluid into the basic profile or out of the basic profile, the connection unit being formed partially or completely from a transparent plastics material.

In the production of hollow, strip-shaped basic profiles from plastics material, in particular in the case of automated production by machine, there is the problem that the basic profile must be connected to the connection unit using a suitable thermal joining method, such as a laser welding method. To solve this problem, the present invention proposes that at least one portion of the connection unit is made transparent. If the connection unit is to be connected to the basic profile, the laser beam can be guided through the transparent portion of the connection unit and can heat the material of the basic profile, so that the connection unit can be welded to the basic profile.

As the expression that the fluid flow channels are "arranged in series" already suggests, the fluid flow channels can in particular be arranged in a single row next to one another. This means, if the strip-shaped basic profile is considered to have two main surfaces, two side surfaces connecting the two main surfaces and extending along the main extension direction of the basic profile, and two end surfaces, then the fluid flow channels run from one end surface to the other end surface and are in each case open at the end surfaces, and the fluid flow channels are arranged side by side as viewed in a direction from one side surface to the other side surface. However, basic profiles with a plurality of parallel rows of fluid flow channels are also conceivable.

The webs which separate two adjacent fluid flow channels from one another can in particular run substantially in a straight line from one main surface inner side to the other main surface, and in this case a cross section of a respective fluid flow channel can be formed substantially rectangular or even square.

The number of fluid flow channels and/or an associated free cross section of a fluid flow channel can remain constant over the extension of the basic profile. Also, some or all of the fluid flow channels, in particular all the fluid flow channels of a row of fluid flow channels except for the two outermost ones (the first and the last fluid flow channel of the row) can have substantially the same cross section as one another. In particular in the case in which the basic profile is rounded on its side surfaces, the fluid flow channels adjacent to a relevant side surface of the basic profile can have a cross section which differs from the other fluid flow channels.

An opening which conducts fluid into/out of the connection unit can be arranged in an extension of the fluid flow channels relative to the main extension of the fluid flow channels, so that fluid flows in substantially the same direction into a connection unit and out of it into the fluid flow channels, or vice versa, or can be arranged at an angle to the main extension of the fluid flow channels, so that fluid flows in a first direction into a connection unit, is then deflected, for example, by 90° and flows out of the connection unit into the fluid flow channels, or vice versa. Furthermore, a plurality of openings of this type can also be provided for each connection unit.

The plastics material of the basic profile and/or of the connection unit can comprise polypropylene. If the connection unit is only partially transparent, portions of the connection unit which are not transparent can be reinforced, for example with talc. In addition, the plastics material of the basic profile and/or of the connection unit can contain other additives such as, for example, boron nitrite, which is particularly suitable for increasing the thermal conductivity of the plastics material.

Customary wall thicknesses of the basic profile can be in a range from 0.5 mm to 0.8 mm, in particular from 0.6 mm to 0.7 mm, but the present invention is not limited thereto.

The connection unit can in particular have a substantially triangular basic shape, as a result of which a fluid flow through the connection unit into/out of the basic profile can be improved.

The connection unit can advantageously be produced using an injection moulding method. The use of an injection moulding method to form the connection unit can offer the advantage that an injection moulding method allows a high degree of design freedom when designing the connection unit, and that the injection moulding method or a component produced using an injection moulding method has good dimensional accuracy within predetermined tolerances. A two-component injection moulding method can be used, for example, in order to be able to form a connection unit that is transparent only in some portions.

As already mentioned above, the connection unit can be connected to the basic profile using a laser welding method. As a result, a process step of arranging the connection unit on the basic profile and subsequently connecting these two components can be fully automated, with the laser welding method also offering the advantage that no additional components, such as adhesives, for example, have to be introduced to connect the basic profile to the connection unit. In particular, in the event that the device according to the invention is used in a specially regulated area, for example with regard to fire protection guidelines, toxic substance regulations and the like, the use of an adhesive to connect the basic profile to the connection unit can limit the usability of the device or, due to use of special adhesives, allow production costs to increase.

In a development of the present invention, the connection unit can be made in multiple parts and can comprise a connection piece and an intermediate piece, the intermediate piece being connected to the basic profile on the one hand and to the connection piece on the other hand, and the intermediate piece being transparent. Thus, initially only the transparent intermediate piece can be connected to the basic profile and then the connection piece can be connected to the intermediate piece. By dividing the connection unit into a connection piece and an intermediate piece, handling of the connection unit during connection to the basic profile can be simplified. Furthermore, since the intermediate piece can be made completely transparent and the connection piece can be made completely non-transparent, the production of the connection unit, for example the injection moulding process, can be simplified.

In particular, the intermediate piece can be designed in such a way that, when the connection unit is connected to the basic profile, it covers both a portion of the outside of the basic profile and also a portion of the outside of the connection piece. In other words, the intermediate piece can be designed so that, on the one hand, a portion of the basic profile can be inserted into the intermediate piece and, on the other hand, a portion of the connection piece can be inserted into the intermediate piece.

The interior of the intermediate piece can have webs which define respective fluid flow channels arranged next to one another, with at least some of the webs protruding beyond one end of an outer wall of the intermediate piece on at least one side of the intermediate piece and, in particular, when the intermediate piece is connected to the basic profile, the webs of the intermediate piece are arranged relative to the webs of the basic profile in the extension of the said webs. This means that the fluid flow channels within the basic profile can be extended into the intermediate piece by the webs of the intermediate piece. Due to the fact that the webs can also project out of the intermediate piece on the opposite side, the fluid flow channels can also be extended into a part of the connection piece.

Furthermore, the webs protruding beyond the wall of the intermediate piece can have the function of pressing outwards a portion of the wall of the connection piece which surrounds the opening of the connection piece to be connected to the intermediate piece. As a result it is possible that the portion of the connection piece which is to be connected, in particular welded, to the intermediate piece can be brought into a predefined close contact with the intermediate piece. Preferably, the opening of the connection piece can be made correspondingly slightly smaller than the height of the webs. In order to be able to simplify the pushing of the connection piece onto the webs of the intermediate piece, the webs of the intermediate piece and/or the wall of the connection piece can have a chamfer or a rounding. In order to be able to insert the connection piece into the intermediate piece, a free space can be provided between the webs and the outer wall of the intermediate piece.

Furthermore, the connection unit can comprise projections which, when connected to the basic profile, protrude into the at least one fluid flow channel and are designed to press at least portions a wall of the basic profile outwards. In particular when an extrusion method is used to produce the basic profile, it can happen that portions of the wall of the basic profile, in particular in the region of the end surfaces of the basic profile and between two adjacent webs, curve into an associated fluid flow channel. In these portions, since there is no longer sufficient contact between the wall of the basic profile and the connection unit, laser welding cannot be carried out, or at least not with sufficient quality. The projections of the connection unit which project into respective fluid flow channels can shift the inwardly curved walls back into their predetermined orientation, so that good surface contact between the basic profile and the connection unit and thus satisfactory laser welding become possible.

Depending on the assignment to a fluid flow channel, the projections of the connection unit can in particular be designed as two plate-like projections running substantially parallel to one another which, when the connection unit is connected to the basic profile, extend partially or completely in an associated fluid flow channel between two adjacent webs along the corresponding wall portion of the two main surfaces of the basic profile. Of course, it is also conceivable that the projections of the connection unit for each fluid flow channel comprise a large number of projections, for example two pin-like projections per main surface/conversion portion of a filling flow channel, in order for a reduction of a cross section of an associated fluid flow channel, which is available for fluid to pass through, to be minimised by the projections.

The connection unit can also comprise a separately formed calibration piece, which is designed to be inserted into the at least one fluid flow channel before the basic profile is connected to the rest of the connection unit, in particular the intermediate piece, and which is designed to press at least portions of a wall of the basic profile outwards. The basic idea of the calibration piece is the same as that of the projections of the connection unit which have been described above, namely to allow wall portions of the basic profile which have fallen inwards to be oriented outwards again. Therefore, reference should be made at this point to the features and advantages of the projections of the connection unit with regard to the calibration piece. However, the calibration piece is formed as an element separate from the connection unit, so that the complexity of the connection unit can be reduced. The calibration piece is intended in particular to remain permanently on the basic profile when the connection unit has been connected to the basic profile.

In particular, the calibration piece can be produced using an injection moulding method. Since during the insertion of the calibration piece into the fluid flow channels of the basic profile, a reduction of the free cross section of an associated fluid flow channel which is available for the passage of fluid inevitably occurs, the calibration piece can be used in particular for, but is not limited to, basic profiles which have fluid flow channels with comparatively large cross sections and/or a comparatively large height of the basic profile of, for example, more than 10 mm. The calibration piece can also be used with the multi-part connection unit and/or particularly thin basic profiles (in the region of 3 mm).

Furthermore, the device can comprise an assembly aid which can be releasably connected to the connection unit, in particular the intermediate piece, and can be releasably connected to the basic profile, and which comprises projections which, when connected to the basic profile, protrude into the at least one fluid flow channel and are designed to press at least portions of a wall of the basic profile outwards. The assembly aid which is accordingly only used during the production of the device and is removed again after the connection unit, in particular the intermediate piece, has been successfully connected to the basic profile, accordingly serves to orient the inwardly curved wall portions of the basic profile until the joining method has been successfully carried out and the basic profile is connected to the connection unit. Consequently, an assembly aid can be reused in the production process of a plurality of devices according to the invention.

In particular, the assembly aid can be designed to carry the intermediate piece on its outside, to be connected together with the intermediate piece to the basic profile and, after non-destructive, non-releasable connection of the intermediate piece to the basic profile, to be releasable from the basic profile and the intermediate piece. This means that the assembly aid can not only be designed to orient the wall portions of the basic profile, but can also serve as a positioning aid for the intermediate piece on the basic profile. Thus, in particular, the intermediate piece can first be placed onto the assembly aid, then the assembly aid with its projections can be inserted into the fluid flow channels of the basic profile, with the intermediate piece being pushed onto the basic profile at the same time, then the intermediate piece and basic profile can be connected or welded to one another and the assembly aid can be removed from the basic profile/intermediate piece unit.

In one embodiment, the basic profile can have a substantially rectangular cross section. The cross section of the basic profile can be substantially constant over the longitudinal extension of the basic profile, i.e. the extension of the basic profile can be constant from one end surface to the other end surface.

A height of the substantially rectangular cross section of the basic profile can be significantly greater than a width of the substantially rectangular cross section of the basic profile, the cross section in particular having a height-to-width ratio of at least 10:1. In this case, the row of mutually adjacent fluid flow channels can be arranged along the height of the basic profile, for example following a straight line.

In a development of the present invention, the basic profile can have a wavy course along its longitudinal direction. The wavy course of the basic profile is particularly suitable for cooling/controlling the temperature of round battery cells in order to be able to produce the largest possible contact region between the battery and the basic profile. In general, however, a straight course of the basic profile is also conceivable, or the basic profile can extend in a straight line over a first predetermined length, then have a change of direction by 180 degrees and run back again in a direction opposite to the first predetermined length.

In a further aspect, the present invention relates to a method for producing a device for controlling the temperature of a component, wherein the method comprises:

providing an elongate basic profile which defines in its interior a plurality of at least two fluid flow channels from one longitudinal end to the other longitudinal end thereof, wherein the fluid flow channels are arranged in series and are separated by webs, and wherein the elongate basic profile is produced from plastics material using an extrusion method; providing a connection unit which can be connected to the basic profile at a longitudinal end of the basic profile and which is designed to conduct fluid into the basic profile or out of the basic profile, wherein the connection unit is formed partially or completely from a transparent plastics material; arranging the connection unit on the basic profile; connecting the connection unit to the basic profile, in particular using a laser welding method.

It should be explicitly pointed out here that all of the features, effects and advantages described in relation to the device according to the invention can also be applied to the method according to the invention, and vice versa.

In the event that the connection unit is designed in multiple parts and comprises a connection piece and an intermediate piece, with the steps of arranging the connection unit on the basic profile and connecting the connection unit to the basic profile, the method can comprise the following steps:

releasably arranging the intermediate piece on an assembly aid; arranging the assembly aid with the intermediate piece on the basic profile, with the assembly aid comprising projections which, when connected to the basic profile, protrude into the at least one fluid flow channel and are designed to press at least portions of a wall of the basic profile outwards; connecting the intermediate piece to the basic profile, in particular using a laser welding method; removing the assembly aid; arranging the connection piece on the intermediate piece; connecting the intermediate piece to the connection piece, in particular using a laser welding method.

As already described in relation to the use of an assembly aid in the device according to the invention, the assembly aid can align wall portions of an associated fluid flow channel in order to ensure a high-quality connection of the connection unit or the intermediate piece to the basic profile. The assembly aid has the advantage that a free cross section of a respective fluid flow channel remains completely available for the passage of fluid since the assembly aid is removed again after the connection unit or the intermediate piece has been connected to the basic profile.

Alternatively or additionally, the connection unit can comprise a separately formed calibration piece, the method comprising the following step before the step of arranging the connection unit on the basic profile:

inserting the calibration piece at least partially into the at least one fluid flow channel, the calibration piece pressing at least portions of a wall of the basic profile outwards.

In comparison to the assembly aid, the calibration piece can be designed to remain permanently on the basic profile.

It should be added at this point that an intermediate piece, as described above, can also be used to connect two basic profiles to one another.

The present invention will be described in greater detail below with reference to the accompanying drawings. In the drawings.

Figure 1:
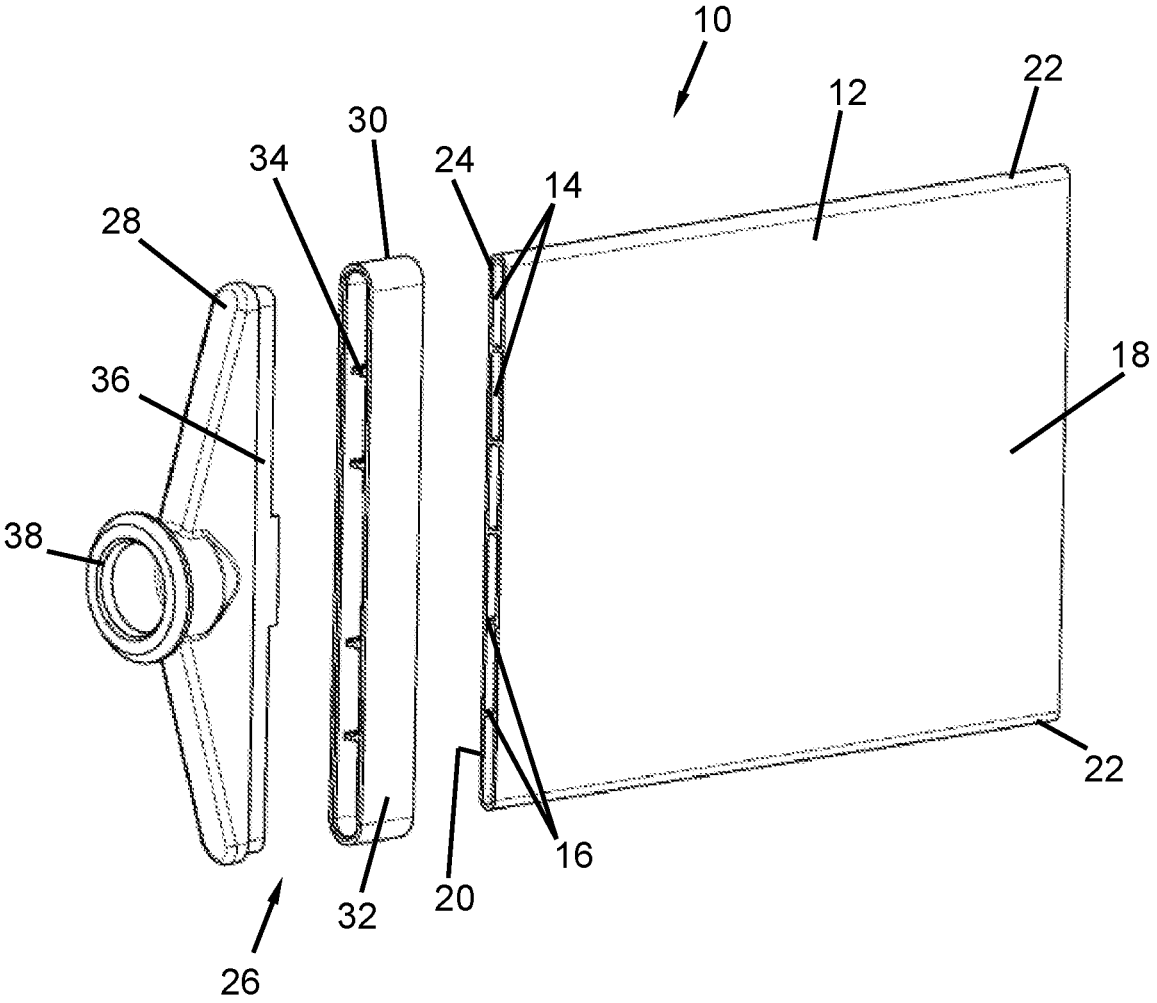
FIG. 1 is an exploded perspective view of a part of an embodiment of the device according to the invention.

In FIG. 1, a device according to the invention is denoted generally by the reference numeral 10, only the region of a longitudinal end of a device 10 according to the invention being shown in FIG. 1. A device 10 according to the invention can be designed analogously at its other longitudinal end. The device 10 comprises a basic profile 12 which has a plurality of fluid flow channels 14 in its interior, which are each separated from one another by webs 16. Here the webs 16 extend substantially in a straight line from a first main surface 18 of the basic profile 12 to an opposing main surface 20. The basic profile 12 has two side surfaces 22 which, in the embodiment shown here, run in a rounded manner between the two main surfaces 18 and 20. The surface of the basic profile 12 on which the fluid flow channels 14 are open to the outside is referred to here as the end surface 24.

The device 10 also comprises a connection unit 26 which is designed here in multiple parts and includes a connection piece 28 and an intermediate piece 30. The intermediate piece 30 is designed to be pushed with its outer wall 32 onto the basic profile 12 in such a way that a region of the basic profile 12 adjoining the end surface 24 of the basic profile 12 is surrounded by the wall 32 of the intermediate piece 30. The intermediate piece 30 is transparent, so that a laser beam can strike the plastics material of the basic profile 12 through the intermediate piece and can melt it. By melting the basic profile 12 and, with it, the intermediate piece 30, the intermediate piece 30 and the basic profile 12 can be connected to one another in a fluid-tight manner.

The interior of the intermediate piece 30 has webs 34, which are aligned with webs 16 of the basic profile 12, so that at least some of the webs 16 of the basic profile 12, when the intermediate piece 30 is arranged on the basic profile 12, are extended by the webs 34 of the intermediate piece 30.

The connection piece 28 has a connecting surface 36 which is designed to be inserted into the intermediate piece 30 so that the intermediate piece 30 can be connected to the connection piece 28 in a manner analogous to the connection of the intermediate piece 30 to the basic profile 12. The connection piece 28 also has an opening 38 via which fluid can be conducted into the basic profile 12 or out of the basic profile 12.

In order to set up a defined stop for the components, it can be provided that a defined distance is set between the connection piece 28 and the basic profile 12 depending on the thickness of a portion of the respective webs 34 which, on the one hand (in the direction of extension of an associated web 34), is in contact with the basic profile and, on the other hand, with the connection piece 28, i.e. the portion of the web 34 which runs between the end surface 24 of the basic profile 12 and an end surface of the connection piece 28 to the outer wall 32, and also that on the connecting surface 36 a contact surface is arranged, against which the intermediate piece 30 rests in the connected state.

Figure 2:
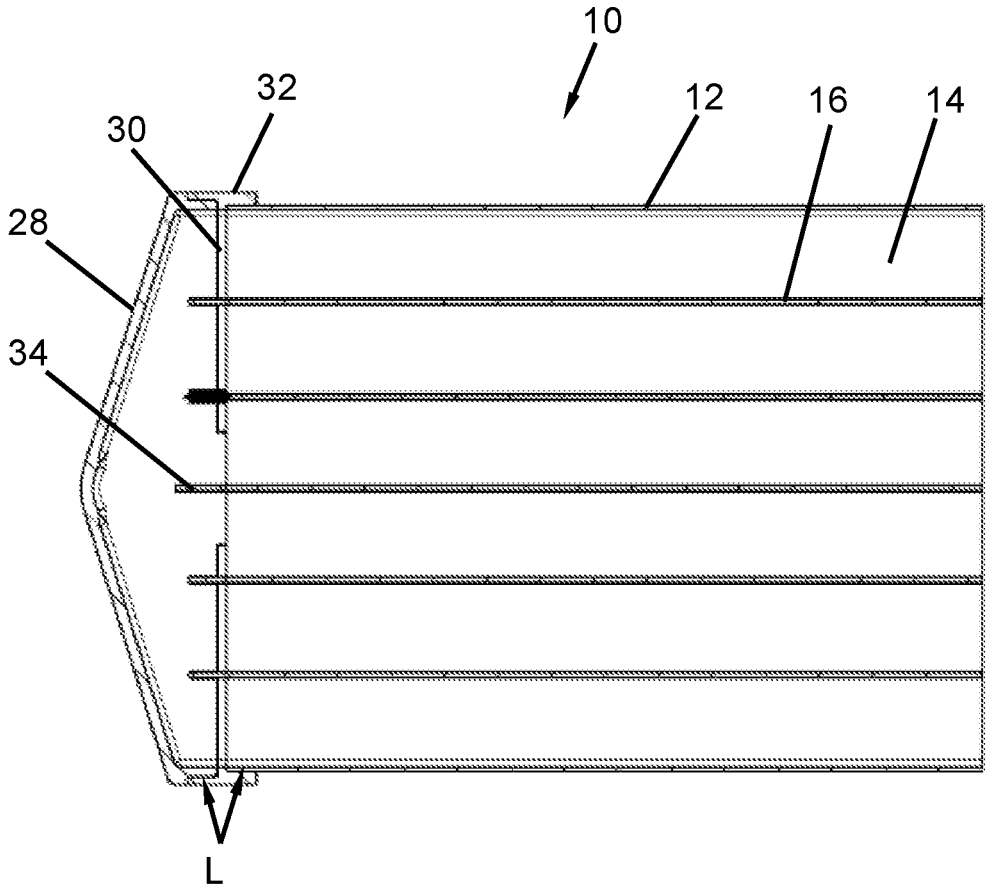
FIG. 2 is a cross-sectional side view of the embodiment of FIG. 1 in a second variant thereof.

FIG. 2 is a cross-sectional side view of the device 10 from FIG. 1 in a slightly modified variant. In this variant, the opening 38 of the connection piece 28 does not run parallel to the direction of extension of the fluid flow channels 14 of the basic profile 12, as shown in FIG. 1, but rather at an angle of 90° relative thereto, so that the opening 38 cannot be seen in FIG. 2. Furthermore, the intermediate piece 30 has at least one web 34 which projects beyond an end of the wall 32 of the intermediate piece 30 which is on the left in FIG. 2. In general, it is conceivable that the webs 34 of the intermediate piece 30 can have different lengths from one another. For example, webs 34 of the intermediate piece 30 which are arranged more centrally, viewed in relation to the direction in which the webs 34 are arranged in sequence side by side (in FIG. 2, the top-down direction), can be longer than webs 34 which are arranged further at one end of the sequence of webs 34 (in FIG. 2, the webs 34 shown at the top and bottom).

The two arrows L in FIG. 2 indicate the points at which the intermediate piece 30 is to be connected to the basic profile 12 or the intermediate piece 30 is to be connected circumferentially to the connection piece 28 by a weld seam.

Figure 3:
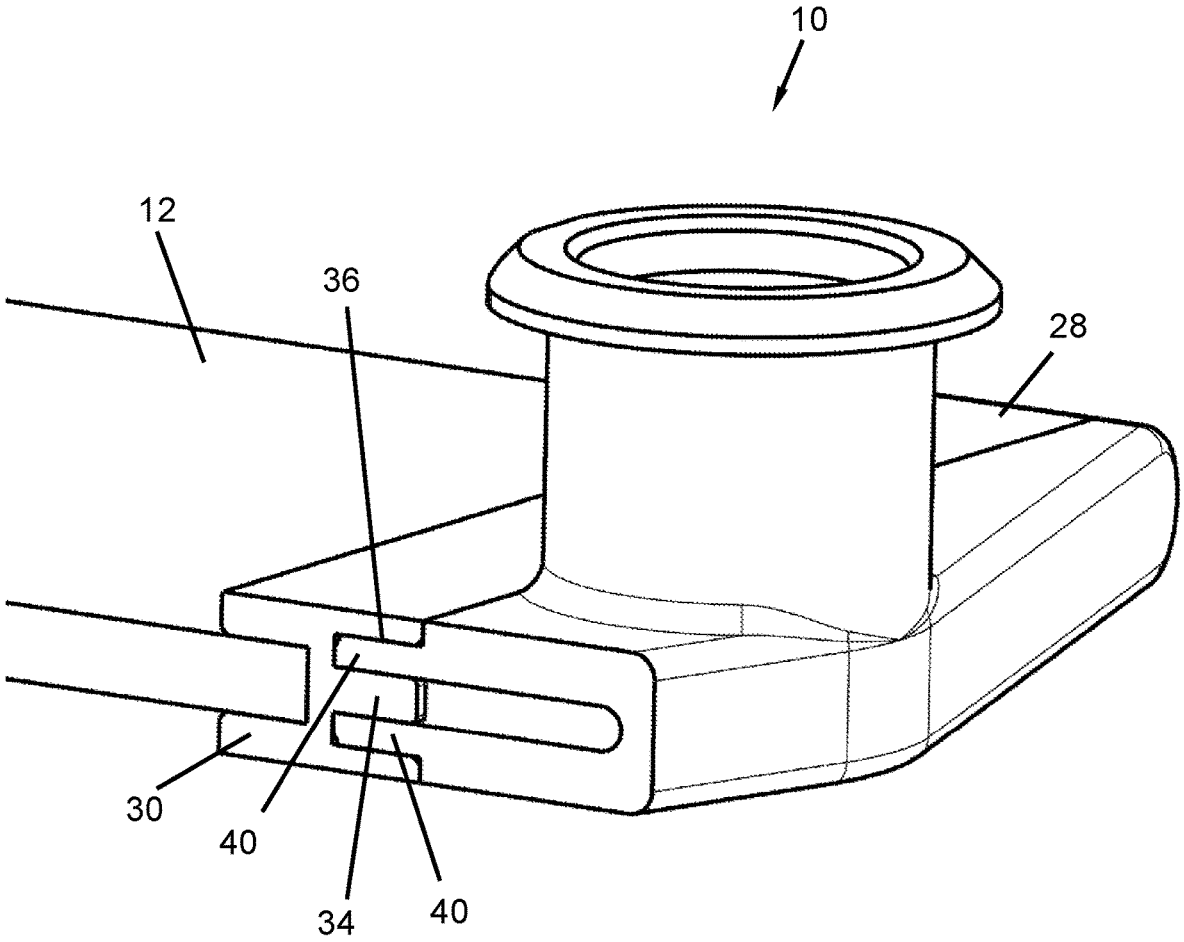
FIG. 3 is a perspective cross-sectional side view of a detail of the variant of FIG. 2.

FIG. 3 shows the detail, already mentioned, that at least one of the webs 34 of the intermediate piece 30 projects into the connection piece 28. It is easy to see that the web 34 of the intermediate piece 30, which is shown in FIG. 3, can press an upper and lower portion 40 of a wall of the connection piece 28 (in this case the connecting surface 36) outwards to ensure close contact between the connection piece 28, i.e. the connecting surface 36 of the connection piece 28, and to produce the intermediate piece 30.

Figure 4:
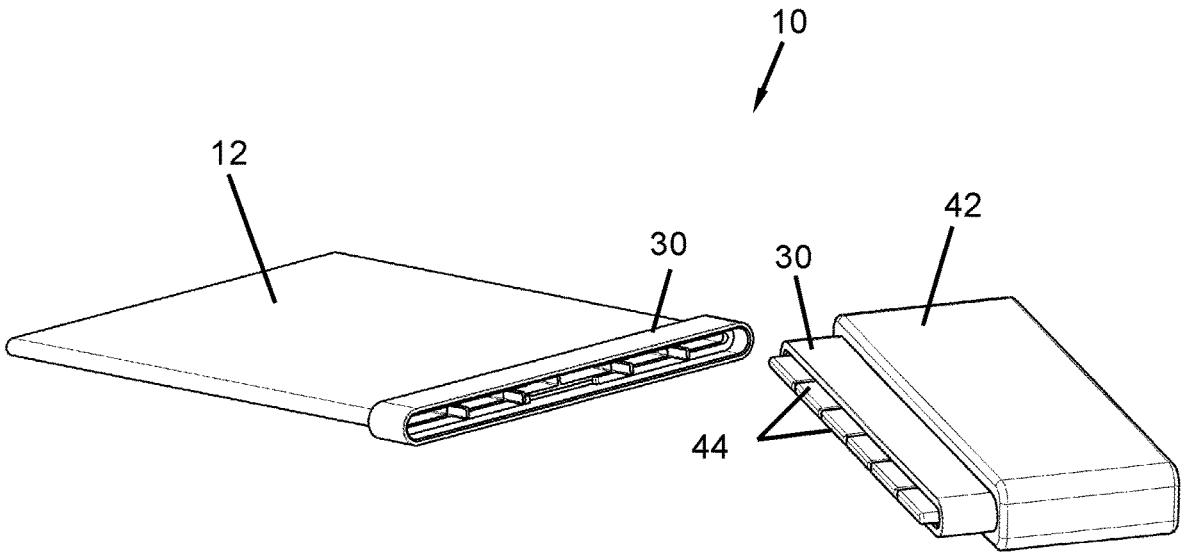
FIG. 4 is a perspective view of a production step of the device according to the invention according to FIG. 1.

FIG. 4 shows a production step in the manufacture of a device 10 according to the invention, in which the intermediate piece 30 is attached to the basic profile 12. In this production step, an assembly aid 42 is used which has a plurality of projections 44 which are matched to the number and design of the fluid flow channels 14 within the basic profile 12. An intermediate piece 30 is arranged on an outside of the projections 44 of the assembly aid 42, as is shown on the right-hand side of FIG. 4. As the next step (not shown), the assembly aid 42 and the intermediate piece 30 arranged thereon are connected to the basic profile 12 in such a way that the projections 44 of the assembly aid 42 are simultaneously inserted into the fluid flow channels 14 of the basic profile 12 and the intermediate piece 30 is pushed onto the basic profile 12. The wall portions of the main surfaces 18 and 20 of the basic profile 12 are pressed outwards between respective webs 16 by the projections 44 so that a close surface contact of the main surfaces 18 and 20 of the basic profile 12 to the intermediate piece 30 can be produced. Then the intermediate piece 30 is connected, in particular welded, to the basic profile 12 and the assembly aid 42 is removed from the basic profile 12 and the intermediate piece 30 connected thereto, as shown on the left-hand side of FIG. 4.

Figure 5:
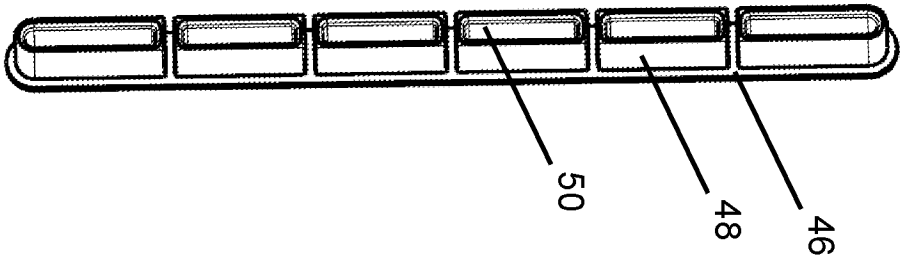
FIG. 5 shows a calibration piece used in the production of a device according to the invention.

FIG. 5 shows a calibration piece 46 which can be used, for example, instead of the assembly aid 42. The calibration piece 46 has a multiplicity of projections 48 which are each provided with through-openings 50 in their interior. The projections 48 are matched to the number and design of the fluid flow channels 14 of an associated basic profile 12. Before a connection unit 26 or an intermediate piece 30 is arranged on a basic profile 12, the calibration piece 46 can be connected by insertion of the calibration piece 46 with its projections 48 into the fluid flow channels 14 of the basic profile 12, the fluid flow channels 14 continuing through the through-openings 50 when the calibration piece 46 is connected to the basic profile 12. Analogously to the projections 44 of the assembly aid 42, the projections 48 of the calibration piece 46 are designed to press the wall portions of the main surfaces 18 and 20 of the basic profile 12 outwards between adjacent webs 16 in order to allow a fluid-tight connection between the connection unit 26 and, in the multi-part embodiment of the connection unit 26, the intermediate piece 30. The calibration piece 46 is designed in particular to remain on the basic profile 12 even after the connection unit 26 or the intermediate piece 30 has been connected to the basic profile 12.

Figure 6:
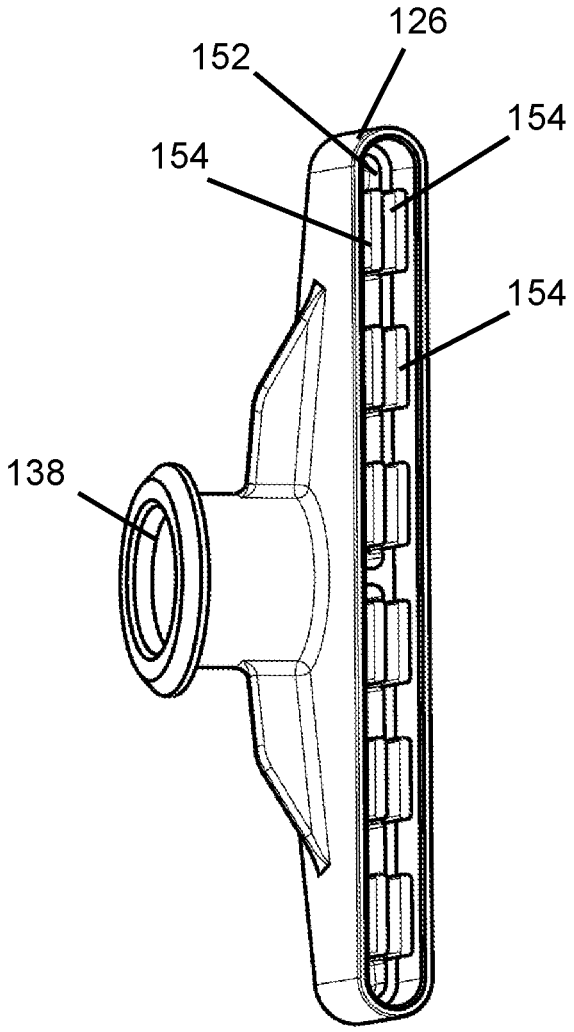
FIG. 6 shows a connection unit according to a further embodiment of the device according to the invention.

FIG. 6 shows a single-part embodiment of a connection unit 126, which basically has the same function as the connection unit 26 of FIGS. 1 and 2, namely to conduct fluid from a fluid line into a basic profile 12 or therefrom into a fluid line, so that reference is made to the description above. The connection unit 126 is designed to be placed directly, i.e. without using an intermediate piece, onto a basic profile 12. A portion of the basic profile 12 is inserted with its corresponding end surface 24 into an opening 152 in the connection unit 126. This portion of the connection unit 126 in which the portion of the basic profile 12 is accommodated can in particular be designed to be transparent in order to allow a laser beam to pass through onto the basic profile 12. Alternatively, the connection unit 126 can also be designed to be completely transparent.

In order also in this embodiment to be able to solve the problem that wall portions of the basic profile 12 are not in sufficiently close contact with the connection unit 126 to allow welding of the connection unit 126 to the basic profile 12, projections 154, which are designed to protrude into corresponding fluid flow channels 14 of the basic profile 12 and to force the above-described wall portions of the main surfaces 18 and 20 of the basic profile 12 outwards and into close contact with the connection unit 126, are arranged in the opening 152. It can be seen in FIG. 6 that two plate-like projections 154 are provided for each fluid flow channel, said projections running substantially parallel to one another in order to be able to shift a wall portion of the main surface 18 of the basic profile 12, on the one hand, and a wall portion of the main surface 20 of the basic profile 12, on the other hand.

It can also be seen in FIG. 6 that laterally adjacent projections 154, which are associated with adjacent fluid flow channels 16 of the basic profile 12, can be at a greater distance from one another than the thickness of a web 16 between two adjacent fluid flow channels 14 of the basic profile 12. Thus, a projection 154 of the connection unit 126 between two webs 16 can only be in contact with a part of the wall portion of the main surface 18 or the main surface 20 of the basic profile 12, in particular a middle portion thereof, as viewed in a direction between two adjacent webs 16. In this way, a larger cross section can remain free for fluid to pass through from an associated fluid flow channel 14 into/out of the connection unit 126.

The connection unit 126 has an opening 138 at an angle of 90° to direct fluid out of/into the connection unit 126.

Figure 7:
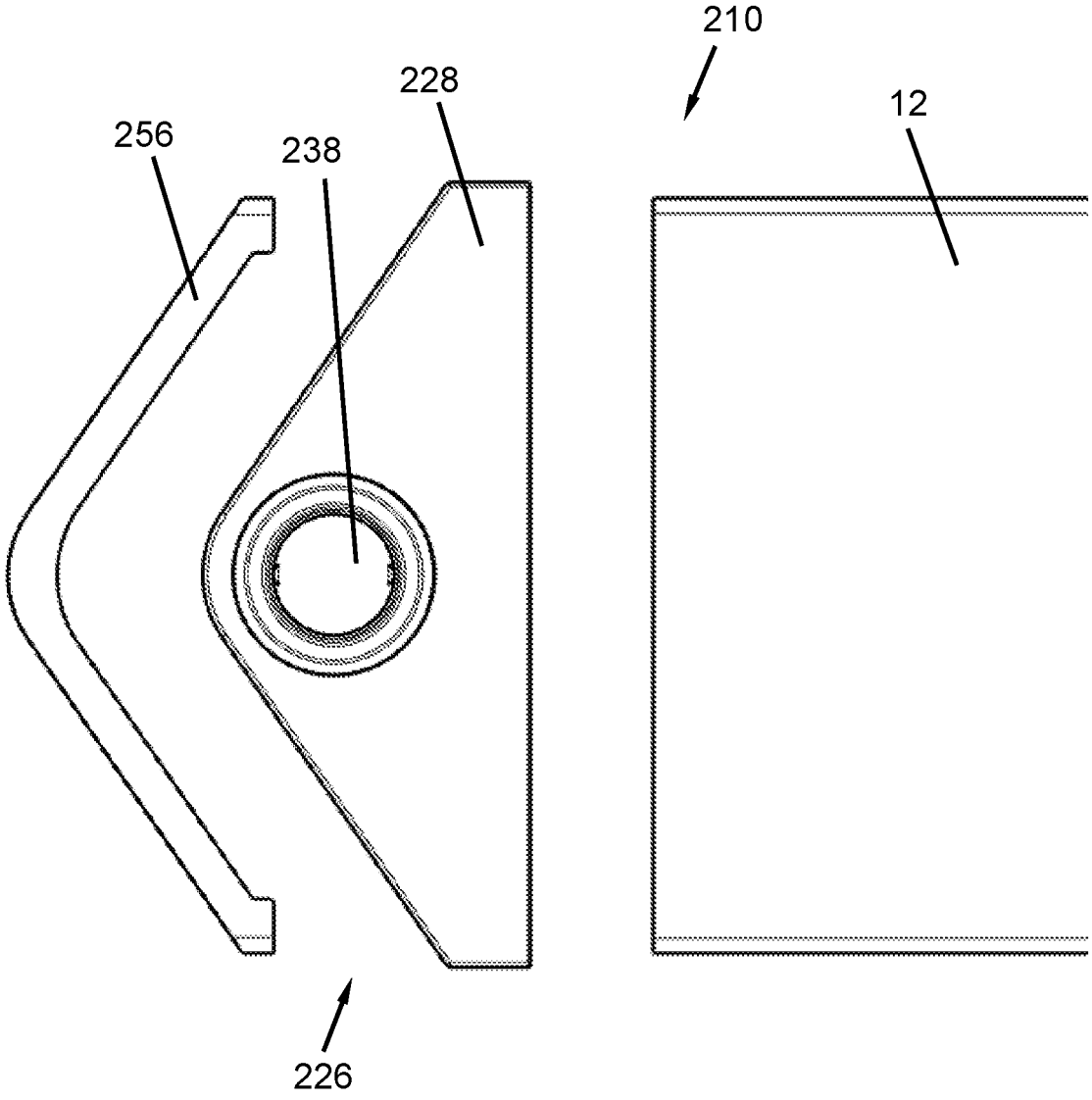
FIG. 7 is an exploded perspective view of a part of a further embodiment of the device according to the invention.

FIG. 7 shows a further embodiment of the device which is provided with the reference numeral 210. Here the basic profile 12 is the same as in the previous embodiments. Otherwise, the embodiment according to FIG. 7 will be explained only with regard to differences from the previous description of the invention.

The connection unit 226 here comprises a connection piece 228 which is generally similar to the connection pieces 28 and 128, again with the opening 238 leading laterally out of the connection piece 228 (as in FIGS. 2, 3 and 6).

Furthermore, the connection unit 226 here comprises a cover 256 which is arranged diametrically opposite the basic profile 12 on the connection piece 228 and is designed to close the connection piece 228 which is open at this point. This has the advantage that an assembly aid (not shown; generally similar to the assembly aid 42) can be inserted through the connection piece 228, from the side on which the cover 256 can be connected to the connection piece 228, through the connection piece 228 and into the basic profile 12, and supports the fluid flow channels 14 of the basic profile 12 during the welding process, i.e. the process of connecting the basic profile 12 to the connection piece 228 (cf. in this connection the function of the calibration piece 46). After the basic profile 12 has been connected to the connection piece 228, the assembly aid can be removed again and the connection piece 228 can be closed with the cover 256 in a fluid-tight manner on the outside of the connection unit 226.

In this case, a calibration piece 46 can be omitted or plate-like projections 154 in the connection unit 226, which can reduce a flow cross section, can be dispensed with.

The invention claimed is:

1. A device for controlling a temperature of a component, wherein the device comprises:

an elongate basic profile that defines, within an interior, a plurality of fluid flow channels from a first longitudinal end to a second longitudinal end, wherein the fluid flow channels are arranged in series and are separated by webs, and the elongate basic profile is extruded from plastic material; and a connection unit that is connected to the elongate basic profile at one of the longitudinal ends of the elongate basic profile and that is designed to direct fluid into the elongate basic profile or out of the basic profile, wherein:

the connection unit is formed partially or completely from a transparent plastics material, the connection unit is made in multiple parts and comprises a connection piece and an intermediate piece, the intermediate piece is connected to the elongate basic profile and to the connection piece, the intermediate piece is transparent, and the interior of the intermediate piece has webs that define respective fluid flow channels arranged adjacent to one another, with at least some of the webs protruding beyond one end of an outer wall of the intermediate piece on at least one side of the intermediate piece wherein when the intermediate piece is connected to the elongate basic profile, the webs of the intermediate piece is arranged relative to the webs of the elongate basic profile in an extension of the webs.

2. The device according to claim 1, wherein the connection unit is produced using injection moulding.

3. The device according to claim 1, wherein the connection unit is connected to the elongate basic profile by laser welding.

4. The device according to claim 1, wherein the connection unit comprises projections that, when connected to the elongate basic profile, protrude into at least one of the fluid flow channels and are designed to press outwards at least portions of a wall of the elongate basic profile.

5. The device according to claim 1, wherein the connection unit also comprises a separately formed calibration piece, wherein the calibration piece is designed to be inserted into the fluid flow channels before the elongate basic profile is connected to the connection unit and the intermediate piece, and that is designed to press outwards against at least portions of a wall of the elongate basic profile.

6. The device according to claim 1, wherein the elongate basic profile has a substantially rectangular cross section.

7. The device according to claim 6, wherein a height of the substantially rectangular cross section of the elongate basic profile is significantly greater than a width of the substantially rectangular cross section of the elongate basic profile, the rectangular cross section having a height-to-width ratio of at least 10:1.

8. The device according to claim 1, wherein the elongate basic profile has a wavy course along its longitudinal direction.

9. A method for producing a device for controlling a temperature of a component, the method comprising:

providing an elongate basic profile that defines in its interior a plurality of fluid flow channels from a first longitudinal end to a second longitudinal end, wherein the fluid flow channels are arranged in series and are separated by webs, and wherein the elongate basic profile is produced from plastics material using an extrusion method;

providing a connection unit connected to the elongate basic profile at one of the longitudinal ends of the elongate basic profile and designed to direct fluid into the elongate basic profile or out of the basic profile, wherein the connection unit is formed partially or completely from a transparent plastics material, and wherein the connection unit is designed in multiple parts and comprises a connection piece and an intermediate piece; and arranging the connection unit on the elongate basic profile and connecting the connection unit to the elongate basic profile by:

releasably arranging the intermediate piece on an assembly aid;

arranging the assembly aid with the intermediate piece on the elongate basic profile, with the assembly aid comprising projections that, when connected to the elongate basic profile, protrude into at least one of the fluid flow channels and are designed to press outwards at least portions of a wall of the elongate basic profile;

connecting the intermediate piece to the elongate basic profile by laser welding;

removing the assembly aid;

arranging the connection piece on the intermediate piece; and connecting the intermediate piece to the connection piece by laser welding.

10. The method according to claim 9, wherein the connection unit comprises a separately formed calibration piece, the method further comprising, before arranging the connection unit on the basic profile, inserting the calibration piece at least partially into at least one of the fluid flow channels, the calibration piece pressing outwards at least portions of a wall of the basic profile.

* * * * *